US011338192B2

(12) United States Patent
Ibach et al.

(10) Patent No.: US 11,338,192 B2
(45) Date of Patent: May 24, 2022

(54) AUTOMATIC FRONT UNIT FOR A SKI BINDING

(71) Applicant: Fritschi AG—Swiss Bindings, Reichenbach im Kandertal (CH)

(72) Inventors: Stefan Ibach, Kirchdorf (CH); Theo Eggimann, Muehlethurnen (CH); Andreas Fritschi, Hilterfingen (CH)

(73) Assignee: FRITSCHI AG—SWISS BINDINGS, Reichenbach im Kandertal (CH)

( * ) Notice: Subject to any disclaimer, the term of this patent is extended or adjusted under 35 U.S.C. 154(b) by 0 days.

(21) Appl. No.: 16/379,079

(22) Filed: Apr. 9, 2019

(65) Prior Publication Data

US 2019/0344153 A1 Nov. 14, 2019

(30) Foreign Application Priority Data

May 8, 2018 (EP) ..... 18171209

(51) Int. Cl.
*A63C 9/08* (2012.01)
*A63C 9/085* (2012.01)
*A63C 9/086* (2012.01)

(52) U.S. Cl.
CPC ..... *A63C 9/0807* (2013.01); *A63C 9/086* (2013.01); *A63C 9/08564* (2013.01); *A63C 9/08571* (2013.01)

(58) Field of Classification Search
CPC ..... A63C 9/08; A63C 9/0805; A63C 9/0807; A63C 9/084; A63C 9/085; A63C 9/08564; A63C 9/08571; A63C 9/086
See application file for complete search history.

(56) References Cited

U.S. PATENT DOCUMENTS 3,606,370 A 9/1971 Spademan
3,794,338 A * 2/1974 Smolka ..... A63C 9/08 280/629

(Continued)

FOREIGN PATENT DOCUMENTS

EP 0 199 098 A2 10/1986
EP 0 754 079 B1 4/1999

(Continued)

*Primary Examiner* — Erez Gurari
(74) *Attorney, Agent, or Firm* — Birch, Stewart, Kolasch & Birch, LLP.

(57) ABSTRACT

The invention relates to an automatic front unit for a ski binding, in particular a touring ski binding, wherein the automatic front unit comprises a first retaining means and a second retaining means for retaining a ski boot in the toe region of the ski boot. This automatic front unit has a first retaining configuration, in which the two retaining means are in a retaining position, in which the two retaining means are at a first distance from one another, wherein the two retaining means can cooperate with the ski boot in the retaining position such that the ski boot is retained at the automatic front unit so as to be pivotable about an axis oriented horizontally in a transverse direction of the ski. Furthermore, the automatic front unit has a step-in configuration, in which the two retaining means are in a step-in position, in which the two retaining means are at a second distance from one another, wherein the second distance is greater than the first distance and wherein the ski boot is released from the two retaining means in the step-in position of the two retaining means, wherein the automatic front unit is adjustable from the step-in configuration into the first retaining configuration and back again. The two retaining means, in order to be adjusted from their step-in position into their retaining position and back again, are mounted so as to be movable in translation relative to one another along an adjustment path, wherein a region of the adjustment path (Continued)

that adjoins the retaining position of the two retaining means is oriented substantially horizontally.

15 Claims, 5 Drawing Sheets

(56) References Cited

U.S. PATENT DOCUMENTS

| | | | | |
|---|---|---|---|---|
| 5,697,631 | A | 12/1997 | Ratzek et al. | |
| 5,735,541 | A | 4/1998 | Fritschi et al. | |
| 2004/0140647 | A1 | 7/2004 | Kogler | |
| 2011/0298196 | A1* | 12/2011 | Lehner | A63C 9/0807 280/611 |
| 2013/0087992 | A1* | 4/2013 | Ibach | A63C 9/22 280/626 |
| 2013/0214513 | A1* | 8/2013 | Barthel | A63C 9/0807 280/614 |
| 2013/0328289 | A1* | 12/2013 | Vailli | A63C 9/003 280/625 |
| 2014/0110919 | A1* | 4/2014 | Convert | A63C 9/10 280/615 |
| 2014/0239615 | A1* | 8/2014 | Rullier | A63C 9/0807 280/616 |
| 2015/0290524 | A1* | 10/2015 | Soldan | A63C 9/10 280/615 |
| 2015/0328529 | A1* | 11/2015 | Trabucchi | A63C 9/10 280/11.33 |
| 2015/0335987 | A1* | 11/2015 | Nobile | A63C 9/086 280/615 |
| 2016/0346664 | A1* | 12/2016 | Mouyade | A63C 9/0807 |
| 2018/0185737 | A1* | 7/2018 | Zoor | A63C 9/0807 |
| 2019/0344153 | A1* | 11/2019 | Ibach | A63C 9/08571 |

FOREIGN PATENT DOCUMENTS

| | | | |
|---|---|---|---|
| EP | 2 574 379 | A2 | 4/2013 |
| WO | WO 02/087710 | A1 | 11/2002 |

* cited by examiner

AUTOMATIC FRONT UNIT FOR A SKI BINDING

TECHNICAL FIELD

The invention relates to an automatic front unit for a ski binding, in particular a touring ski binding, said automatic front unit comprising a first retaining means and a second retaining means for retaining a ski boot in the toe region of the ski boot. Here, the automatic front unit has a first retaining configuration, in which the two retaining means are in a retaining position, in which the two retaining means are at a first distance from one another, wherein the two retaining means can cooperate with the ski boot in the retaining position such that the ski boot is retained at the automatic front unit so as to be pivotable about an axis oriented horizontally in a transverse direction of the ski. Furthermore, the automatic front unit has a step-in configuration, in which the two retaining means are in a step-in position, in which the two retaining means are at a second distance from one another, wherein the second distance is greater than the first distance and wherein the ski boot is released from the two retaining means in the step-in position of the two retaining means. In this case, the automatic front unit is adjustable from the step-in configuration into the first retaining configuration and back again.

PRIOR ART

In terms of their function, ski bindings are able to be classified into downhill ski bindings, which are used only for skiing downhill and for skiing on ski lifts, and touring bindings, which are additionally used for walking on skis, in particular for climbing with the aid of climbing skins fastened to the skis. While the former merely need to ensure that the ski boot is fixed reliably to the ski in what is known as a downhill position, the latter, for climbing, additionally have to be able to be moved from the downhill position into a climbing position, in which the ski boot is liftable from the ski in the heel region so as to be pivotable about an axis oriented horizontally in the transverse direction of the ski, in order, for walking, to allow an articulated movement between the ski boot and the ski.

Touring ski bindings in turn are able to be classified into two types. One type comprises a ski boot carrier that is pivotable with respect to the ski, the ski boot being held on said ski boot carrier by binding jaws. A representative member of this type of touring ski bindings is described for example in EP 0 754 079 B1 (Fritschi A G). By contrast, the second type of touring ski binding does not comprise such a ski boot carrier. In this type, the ski boot is mounted so as to be pivotable in its toe region at the sole in an automatic front unit mounted in a manner fixed to the ski. In this case, the automatic heel unit is likewise attached fixedly to the ski at a distance from the automatic front unit that is adapted to the length of the sole of the ski boot, and, in the downhill position, locks the boot in the region of the heel. In the climbing position, the boot heel is released from the automatic heel unit, however, such that the heel of the ski boot can be lifted off the ski and such that the ski boot can be pivoted about the mounting at the automatic front unit. Ski boots that are suitable for this binding type typically have, to this end, two lateral recesses in the toe region for pivotably mounting in the automatic front unit. In addition, such ski boots typically have a rigid or only slightly flexible sole. In the heel region of this sole, rearwardly open recesses are typically provided, in which retaining means of the automatic heel unit can engage.

In order to describe such binding systems, a (notional) ski is often used as reference system, wherein it is assumed that the binding is mounted on this ski. This practice is adopted in the present text. In this reference system, the expression "longitudinal direction of the ski" means along the orientation of the longitudinal axis of the ski. Similarly, "parallel to the ski" means, for an elongate object, oriented along the longitudinal axis of the ski. By contrast, for an extensive object, the expression "parallel to the ski" means oriented parallel to the sliding surface of the ski.

Furthermore, the expression "transverse direction of the ski" means a direction transverse to the longitudinal direction of the ski, although this does not have to be oriented exactly at right angles to the longitudinal axis of the ski. Its orientation can also deviate somewhat from a right angle. The expression "centre of the ski" in turn means a centre of the ski as seen horizontally in the transverse direction of the ski, while the expression "fixed to the ski" means not movable with respect to the ski. In addition, it should be noted that expressions that do not contain the word "ski" also refer to the reference system of the (notional) ski. Thus, the terms "front/forward", "rear/rearward", "top/upward", "bottom/downward" and "lateral" relate to "front/forward", "rear/rearward", "top/upward", "bottom/downward" and "lateral" in respect of the ski. Equally, terms such as "horizontal" and "vertical" also relate to the ski, wherein "horizontal" means lying in a plane parallel to the ski and "vertical" means oriented perpendicularly to this plane.

A touring ski binding of the second type introduced above is described in EP 0 199 098 A2 (Bartel) and marketed under the brand name Dynafit. The automatic front unit of that touring ski binding comprises two angle levers, which are arranged opposite one another in the transverse direction of the ski and are each mounted so as to be pivotable about an axis extending in the longitudinal direction of the ski. The two angle levers each have an upwardly directed and laterally oriented arm, these arms being arranged at right angles to one another. The upwardly oriented arms each comprise a frustoconical or hemispherical stud pointing towards the centre of the ski, said stud being able to engage in lateral depressions, provided for this purpose, in the toe region of a ski boot and thus serving as retaining means for retaining a ski boot. The laterally oriented arms of the angle levers point, like the pins, towards the centre of the ski, but are operatively connected together via a spring device. Since the two angle levers are mutually spring-loaded by the spring device via the laterally oriented arms, they can snap into place downwardly and upwardly by overcoming a dead centre position in which the two laterally directed arms are oriented in rectilinear continuation of one another. When the laterally oriented arms have snapped into place downwardly, the upwardly directed arms are in a pivoted-together state. By contrast, when the laterally oriented arms have snapped into place upwardly, the upwardly directed arms are in a pivoted-apart state. Accordingly, the studs for retaining a ski boot are closer together in the first case and farther apart in the second case. As a result, in the first case, a ski boot can be secured, or mounted so as to be pivotable, between the two angle levers by means of the studs. Therefore, this configuration of the automatic front unit is a retaining configuration, in which the two studs are in a retaining position. By contrast, in the second state, the retaining means are sufficiently far apart from one another that the ski boot is released. Accordingly, this configuration of the automatic front unit is a step-in configuration, in which the two studs are in a step-in position.

Since, in the case of the automatic front unit described in EP 0 199 098 A2, the two angle levers are mutually spring-loaded by the spring device via the laterally oriented arms, they can, as mentioned above, snap into place downwardly and upwardly by overcoming a dead centre position in which the two laterally directed arms are oriented in rectilinear continuation of one another. In this case, the upwardly directed arms are in a pivoted-together state when the laterally oriented arms have snapped into place downwardly, and in a pivoted-apart state when the upwardly directed arms are in the pivoted-together state. Thus, in the retaining configuration of the automatic front unit, when a ski boot is retained in the automatic front unit, a small, upwardly directed force on the ski boot or a small, downwardly directed force on the automatic front unit suffices for the angle levers to be pivoted over the dead centre position and for the automatic front unit to be adjusted from the retaining configuration into the step-in configuration and the ski boot to be released from the automatic front unit. Accordingly, during skiing, it is possible, on account of bumps and knocks, for unintentional releases to occur, in which the ski boot is accidentally released from the automatic front unit. Therefore, there is an increased risk of an accident for the skier when using an automatic front unit according to EP 0 199 098 A2.

A further automatic front unit belonging to the second type of touring ski bindings is described in EP 2 574 379 A2 (Fritschi A G). That automatic front unit comprises two upwardly directed levers, which are arranged opposite one another in the transverse direction of the ski and are each mounted so as to be pivotable about an axis extending in the longitudinal direction of the ski. Arranged in the region of the upper ends of these levers are frustoconical studs, which can engage in depressions provided for this purpose in the toe region of a ski boot and thus serve as retaining means for retaining the ski boot. In the retaining configuration of said automatic front unit, the studs have been pivoted towards one another into a retaining position by the levers in order to retain the ski boot. In the step-in configuration of the automatic front unit, by contrast, the two studs have been pivoted apart into a step-in position by the two levers. In the retaining position, the pivoting movement of the levers is blocked. Thus, any pivoting apart of the studs from the retaining position into the step-in position is also blocked. Instead, in the retaining configuration of the automatic front unit, the studs can be moved in translation horizontally in the transverse direction of the ski within a region counter to a spring force by the levers in the retaining position.

As soon as the studs have been moved in translation laterally to a sufficient extent by the levers, the lever lying in the direction of movement is released and so the corresponding lever can tip away laterally together with the corresponding stud. This allows a safety release.

The automatic front unit according to EP 2 574 379 A2 prevents unintentional releases, which can occur in the case of the automatic front unit according to EP 0 199 098 A2 in the event of an upwardly directed force acting on the ski boot or in the event of a downwardly directed force acting on the automatic front unit. Thus, the automatic front unit according to EP 2 574 379 A2 increases safety for the skier. However, the automatic front unit according to EP 2 574 379 A2 has a very complex design. This has the result that the automatic front unit is relatively expensive to produce. Moreover, this has the result that, on account of the large number of constituent parts, the automatic front unit is relatively heavy.

SUMMARY OF THE INVENTION

The object of the invention is to create an automatic front unit belonging to the technical field mentioned at the beginning, said automatic front unit being lightweight, cost-effective to produce and affording the skier increased safety.

The object is achieved by the features of Claim 1. According to the invention, the two retaining means, in order to be adjusted from their step-in position into their retaining position and back again, are mounted so as to be movable in translation relative to one another along an adjustment path, wherein a region of the adjustment path that adjoins the retaining position of the two retaining means is oriented substantially horizontally. Here, substantially horizontally preferably means that, at each point of the adjustment path within the region adjoining the retaining position of the two retaining means, a tangent applied to the respective point on the adjustment path assumes an angle of at most 45° to a plane parallel to the ski, or that the tangent applied to the respective point on the adjustment path assumes an angle in the region of at least 45° to at most 90° to a vertically oriented line.

Thus, the two retaining means, in order to be adjusted from their step-in position into their retaining position and back again, are mounted so as to be movable in translation substantially horizontally in the region of their retaining position. Accordingly, compared with the automatic front unit described in EP 0 199 098 A2, the two retaining means are moved away from their retaining position, such that the ski boot is released, only by a relatively large upwardly directed force acting on the ski boot or a relatively large downwardly directed force acting on the automatic front unit. Accordingly, in the case of the automatic front unit according to the invention, the frequency of unintentional releases is reduced, with the result that the risk of accidents is reduced. At the same time, the automatic front unit according to the invention can have a less complex design and thus be easy and cost-effective to produce. The smaller the angle between the tangent applied to the adjustment path at the respective point within the region of the adjustment path adjoining the retaining position of the two retaining means and a plane parallel to the ski is, or the closer the angle between the tangent and the vertically oriented line is to 90°, the more the frequency of unintentional releases is reduced.

For this reason, particularly preferably, at each point of the adjustment path within the region adjoining the retaining position of the two retaining means, the tangent applied to the respective point on the adjustment path assumes an angle of at most 20° to a plane parallel to the ski or the tangent applied to the respective point on the adjustment path assumes an angle in the range of at least 70° to at most 90° to a vertically oriented line. Therefore, very particularly preferably, at each point of the adjustment path within the region adjoining the retaining position of the two retaining means, the tangent applied to the respective point on the adjustment path assumes an angle of at most 10° to a plane parallel to the ski or the tangent applied to the respective point on the adjustment path assumes an angle in the range of at least 80° to at most 90° to a vertically oriented line. However, most preferably, the region of the adjustment path adjoining the retaining position of the two retaining means is oriented horizontally or, most preferably, at each point of the adjustment path within the region adjoining the retaining position of the two retaining means, the tangent applied to the respective point on the adjustment path lies in a plane parallel to the ski.

Preferably, the region of the adjustment path adjoining the retaining position of the two retaining means has a length of at least 30%, particularly preferably at least 55%, very particularly preferably at least 80% and most preferably 100% of a length of the adjustment path. The greater this percentage in the adjustment path of the region of the adjustment path adjoining the retaining position of the two retaining means, the smaller the probability of an unintentional release on account of an upwardly directed force acting on the ski boot or a downwardly directed force acting on the automatic front unit. In this case, the length of the adjustment path relates preferably to the length of the adjustment path measured on the movement path of the retaining means upon adjustment of the retaining means from its retaining position to its step-in position.

Preferably, the two retaining means are mounted such that the two retaining means are only moved in translation relative to one another in the region of the adjustment path adjoining the retaining position of the two retaining means. If the two retaining means are additionally mounted so as to be pivotable, the two retaining means are preferably mounted such that they are pivoted relative to one another only outside the region of the adjustment path adjoining the retaining position of the two retaining means.

In a first preferred variant, the two retaining means are mounted such that, when they are adjusted from their step-in position into their retaining position and back again, they are only moved in translation relative to one another. This has the advantage of allowing easy stable mounting of the retaining means. In a second preferred variant, by contrast, the retaining means are mounted such that, when they are adjusted from their step-in position into their retaining position and back again, they are moved in translation relative to one another and pivoted relative to one another. This second variant has the advantage that it is possible to optimize positioning of the retaining means in the step-in position and in the retaining position for the respective purposes. Particularly preferably, the two retaining means are mounted, in the second variant, such that they are only moved in translation relative to one another in the region of the adjustment path adjoining the retaining position of the two retaining means and are correspondingly pivoted relative to one another only outside this region of the adjustment path. Both in the first and in the second preferred variant, the retaining means are mounted so as to be movable in translation. At least in the second variant, the two retaining means are additionally mounted so as to be pivotable. In the first variant, too, the two retaining means can additionally be mounted so as to be pivotable. In this case, however, the two retaining means are not pivoted when they are adjusted between their retaining position and their step-in position, but are pivoted only when they are adjusted between their retaining position and a further position or between their step-in position and a further position, or only when they are adjusted between further positions.

As an alternative to these variants, it is also possible for the two retaining means to be mounted such that the two retaining means are moved in translation and pivoted relative to one another in the region of the adjustment path adjoining the retaining position of the two retaining means.

Preferably, the automatic front unit comprises a base element and/or a housing. In this case, the base element can be formed in one or more parts. The housing can also be formed in one or more parts. If the automatic front unit comprises only a base element and no housing, the base element is preferably designed for fastening the automatic front unit to a ski. If the automatic front unit comprises only a housing and no base element, the housing is preferably designed for fastening the automatic front unit to a ski. If, by contrast, the automatic front unit comprises both a base element and a housing, the base element, the housing or both the base element and the housing are designed for fastening the automatic front unit to a ski. Alternatively, however, it is also possible for the automatic front unit to comprise neither a base element nor a housing.

Preferably, each of the two retaining means is a stud having a free end, wherein the two studs are arranged opposite one another on either side of the centre of the ski and are arranged with their free ends pointing towards the centre of the ski. This has the advantage that the ski boot can be retained easily at the automatic front unit so as to be pivotable about an axis oriented horizontally in the transverse direction of the ski in that the studs engage laterally in recesses in the toe region of the ski boot.

Alternatively, however, it is also possible for the retaining means to be configured in some other way. For example, the retaining means can be openings that are located opposite one another on either side of the centre of the ski and are open towards the centre of the ski, studs that are arranged laterally on the ski boot being able to engage in said openings in order to retain the ski boot in the toe region of the ski boot.

Advantageously, the automatic front unit has a first retaining lever and a second retaining lever, wherein the two retaining levers are arranged opposite one another on either side of the centre of the ski, wherein the first retaining means is arranged on the first retaining lever in an upper region of the first retaining lever and the second retaining means is arranged on the second retaining lever in an upper region of the second retaining lever. This has the advantage that the automatic front unit can be designed in a compact and lightweight manner, since relatively little space and material are required for the retaining levers.

Preferably, in this case, the two retaining levers are arranged in a substantially vertically oriented manner and oriented in a manner pointing upwards in the first retaining configuration of the automatic front unit. This has the advantage that the retaining levers can be arranged in a space-saving manner, thereby allowing a compact design of the automatic front unit. In a variant thereto, in the first retaining configuration of the automatic front unit, the two retaining levers are oriented in a manner pointing towards the rear or towards the front substantially in the longitudinal direction of the ski. Alternatively, however, it is also possible for the two retaining levers to be oriented in some other way in the first retaining configuration of the automatic front unit.

Regardless of whether or not the two retaining levers are arranged in a substantially vertically oriented manner and oriented in a manner pointing upwards in the first retaining configuration of the automatic front unit, the two retaining means are preferably each a stud having a free end, wherein the two studs are arranged opposite one another on either side of the centre of the ski and with their free ends pointing towards the centre of the ski on a side of the respective retaining lever facing the centre of the ski. This has the advantage that, in the first retaining configuration, a ski boot can be retained at the automatic front unit so as to be easily pivotable about the axis oriented horizontally in the transverse direction of the ski. In a variant thereto, however, it is also possible for the retaining means to be configured in some other way and, for example as mentioned above, have openings that are located opposite one another on either side of the centre of the ski and are open towards the centre of the ski, studs that are arranged laterally on the ski boot being able to engage in said openings in order to retain the ski boot in the toe region of the ski boot.

Alternatively, however, it is also possible for the automatic front unit not to have a first and a second retaining lever, wherein the two retaining levers are arranged opposite one another on either side of the centre of the ski and wherein the retaining means are arranged in the upper regions of the retaining levers.

Preferably, the two retaining means, in order to be adjusted from their step-in position into their retaining position and back again, are mounted so as to be movable in translation relative to one another along the adjustment path in that the first retaining means is mounted so as to be movable in translation and the second retaining means is mounted so as to be movable in translation. This has the advantage that, in order to adjust the automatic front unit from the step-in configuration into the first retaining configuration and back again, both the first retaining means and the second retaining means can be moved, and that, in this way, it can be easier for the skier to step into the automatic front unit, because all that is necessary is to position the ski boot relative to the automatic front unit, after which the two retaining means can be moved in order to retain the ski boot in their retaining position.

In order to allow the first retaining means to be mounted so as to be movable in translation and the second retaining means to be mounted so as to be movable in translation, the first retaining means and the second retaining means can each be mounted so as to be movable in translation on one and the same third element of the automatic front unit, or the first retaining means and the second retaining means can each be mounted on a different further element of the automatic front unit. In this case, the third element, or one of the two further elements, can be for example the possibly present housing of the automatic front unit or the possibly present base element of the automatic front unit. The third element, or one of the two further elements, can also be other elements of the automatic front unit, however.

Regardless of what the first retaining means and the second retaining means are mounted on so as to be movable in translation, the first retaining means and the second retaining means are preferably mounted so as to be movable in translation in the transverse direction of the ski, wherein the region of the adjustment path adjoining the retaining position of the two retaining means is oriented substantially horizontally, or wherein, preferably, for each point within this region of the adjustment path, the tangent applied to the respective point assumes an angle of at most 45°, particularly preferably at most 20°, very particularly preferably at most 10° to a plane parallel to the ski, and wherein the tangent applied to the respective point is most preferably oriented horizontally.

Alternatively, however, it is also possible for it not to be the case that both the first retaining means is mounted so as to be movable in translation and the second retaining means is mounted so as to be movable in translation.

Advantageously, the automatic front unit comprises a first carriage and a second carriage, wherein the first retaining means is arranged on the first carriage and the second retaining means is arranged on the second carriage, wherein the first carriage is mounted so as to be movable in translation and the second carriage is mounted so as to be movable in translation, with the result that the two retaining means, in order to be adjusted from their step-in position into their retaining position and back again, are mounted so as to be movable in translation relative to one another along the adjustment path in that the first retaining means is mounted so as to be movable in translation by the first carriage and the second retaining means is mounted so as to be movable in translation by the second carriage. This has the advantage that the two retaining means are mounted so as to be movable in translation easily and stably.

In this case, the first carriage and the second carriage can each be mounted so as to be movable in translation on one and the same third element of the automatic front unit or the first carriage and the second carriage can each be mounted on a different further element of the automatic front unit. In this case, the third element, or one of the two further elements, can be for example the possibly present housing of the automatic front unit or the possibly present base element of the automatic front unit. This third element, or one of the two further elements, can also be other elements of the automatic front unit, however.

Regardless of what the first carriage and the second carriage are mounted on so as to be movable in translation, the first carriage and the second carriage are preferably mounted so as to be movable in translation in the transverse direction of the ski. As a result, the first retaining means and the second retaining means are preferably also mounted so as to be movable in translation in the transverse direction of the ski, wherein the region of the adjustment path adjoining the retaining position of the two retaining means is oriented substantially horizontally, or wherein, preferably, for each point within this region of the adjustment path, a tangent applied to the respective point assumes an angle of at most 45°, particularly preferably at most 20°, very particularly preferably at most 10° to a plane parallel to the ski, and wherein the tangent applied to the respective point is most preferably oriented horizontally. Thus, the first carriage and the second carriage are preferably also mounted so as to be movable in translation substantially horizontally in the transverse direction of the ski and thus preferably in a direction with an inclination of at most 45°, particularly preferably at most 20°, very particularly preferably 10° and most preferably in a horizontally oriented plane, in a translation region of the carriages which corresponds to the region of the adjustment path adjoining the retaining position of the two retaining means.

If the automatic front unit has two retaining levers, wherein the two retaining levers are arranged opposite one another on either side of the centre of the ski, wherein one of the two retaining means is arranged on each of the two retaining levers in an upper region of the respective retaining lever, preferably a first of the two retaining levers is arranged on the first carriage and a second of the two retaining levers is arranged on the second carriage. In this case, the first retaining lever and the first carriage can be formed together in one piece or as separate pieces. In the same way, the second retaining lever and the second carriage can be formed together in one piece or as separate pieces. Regardless of whether the retaining levers and the corresponding carriages are formed together in one piece or as separate pieces, the arrangement of the retaining levers on the carriages has the advantage of allowing stable mounting of the retaining means.

If the first retaining lever and the first carriage are formed together in one piece and the second retaining lever and the second carriage are formed together in one piece, it is irrelevant whether the pieces are formed in one or more parts. Regardless thereof, the piece of the first retaining lever and the first carriage and the piece of the second retaining lever and the second carriage are preferably formed in a rigid manner. In this case, rigid means preferably that, when an external force acts thereon, the respective piece bends elastically by at most a limit value without the piece breaking. In order to determine this limit value, the starting point is preferably two points in the respective piece, wherein the first point is located in the carriage in the region of the mounting of the carriage and wherein the second point is located in the retaining lever at the location at which the retaining means belonging to the retaining lever is arranged. In this case, the rest distance is assumed to be the distance between the two points when an external force is not acting on the piece. Furthermore, one of the two points is fixed in space, while the translation distance of the position of the other point in space without an external force acting thereon is determined using the position of this other point in space when an external force is acting on the piece. Preferably, for each possible pair of points and each possible acting force, in the respective piece, the translation distance is at most 1%, particularly preferably at most 0.1% and very particularly preferably at most 0.01% of the rest distance. Thus, this preferred definition of rigid is not a purely material-dependent constant, but is also dependent on the shape and manner of construction of the respective piece.

If the first retaining lever and the first carriage are configured as separate pieces and the second retaining lever and the second carriage are configured as separate pieces, in a preferred variant, the first retaining lever is mounted on the first carriage so as to be pivotable about a first axis and the second retaining lever is mounted on the second carriage so as to be pivotable about a second axis. This has the advantage that, for example, the automatic front unit can be configured such that a ski boot retained in the automatic front unit is released optimally from the automatic front unit if the skier falls, and thus a safety release is allowed. To this end, the automatic front unit comprises preferably lever blocking means which, in the first retaining configuration of the automatic front unit, are in a lever blocking position and by which, in the first retaining configuration of the automatic front unit, at least a pivoting movement of the retaining lever with the retaining means away from the centre of the ski about the respective axis relative to the respective carriage is blocked, wherein the lever blocking means are adjustable into a lever release position, in which the pivoting movement of the retaining lever with the retaining means about the respective axis relative to the respective carriage away from the centre of the ski is enabled. Thus, when the lever blocking means are in the lever release position, one or both of the retaining levers can be pivoted with the respective retaining means about the respective axis relative to the respective carriage away from the centre of the ski, and thus the corresponding one of the two retaining means is pivoted not only away from its retaining position but also out of a movement path, leading away from the automatic front unit, of the ski boot, in order to release the ski boot optimally from the automatic front unit in the event of a fall.

When the automatic front unit allows such a safety release, the lever blocking means are adjustable from the lever blocking position into the lever release position preferably by a load exceeding a predetermined limit value and acting on at least one of the two retaining means. Therefore, the automatic front unit comprises preferably a preloaded elastic element, the preloading of which causes the two retaining means to be preloaded towards their retaining position with a retaining force in the first retaining configuration of the automatic front unit. Since the two retaining means are preloaded towards their retaining position by this elastic element in the first retaining configuration of the automatic front unit, the two retaining means can be pushed away from their retaining position counter to the preloading of the elastic element when the skier falls. Only when the load or force acting on at least one of the two retaining means in the event of such a fall is sufficiently large are the two retaining means pushed apart away from their retaining position counter to the preloading of the elastic element. As a result, the two retaining means are moved apart by the first retaining lever being moved in translation with the first carriage and the second retaining lever being moved in translation with the second carriage. If in this case the load exceeds the predetermined limit value, the two retaining means are moved apart beyond a particular spacing by the two retaining levers and the first carriage and the second carriage being moved in translation. Thus, the two retaining means, the two retaining levers and the first carriage and the second carriage exceed a position in which the lever blocking means are adjusted into the lever release position, with the result that the two retaining levers are released and can be pivoted away about the respective axis with the respective retaining means.

As a result of the pivoting away, allowed as a result, of one or of both retaining means with the respective retaining lever, the automatic front unit can be adjustable into a release configuration. This release configuration differs from the first retaining configuration and the step-in configuration of the automatic front unit. Thus, in this case, the automatic front unit has the abovementioned release configuration and the first retaining configuration and the step-in configuration. As a result of the pivoting away of one or of both retaining means with the respective retaining lever, the automatic front unit can also be adjustable into a configuration which is identical to the step-in configuration, however. In this case, the automatic front unit does not have a release configuration, but rather the first retaining configuration and the step-in configuration. Regardless of whether or not the automatic front unit, as explained, has a release configuration, the automatic front unit can, in addition to the step-in configuration, the first retaining configuration and the possible release configuration, also have further configurations, for example a second retaining configuration.

In order to allow an above-described safety release, it is irrelevant whether the first axis and the second axis are oriented vertically, in the longitudinal direction of the ski or in some other orientation. However, it is particularly advantageous when the first axis and the second axis are each oriented in the longitudinal direction of the ski, because, as a result, a compact design of the automatic front unit is allowed.

Regardless of whether or not the automatic front unit allows an above-described safety release, the two retaining levers can be arranged in a substantially vertically oriented manner and oriented in a manner pointing upwards in the first retaining configuration of the automatic front unit, or can be oriented in another direction, for example in the longitudinal direction of the ski. If the first axis and the second axis are oriented vertically, the two retaining levers are oriented preferably in the longitudinal direction of the ski in the first retaining configuration of the automatic front unit. If, by contrast, the first axis and the second axis are oriented in the longitudinal direction of the ski, the two retaining levers are arranged preferably in a substantially vertically oriented manner and oriented in a manner pointing upwards in the first retaining configuration of the automatic front unit.

Preferably, the automatic front unit comprises a slide, which is operatively connected to the first carriage and the second carriage and which is movable by the first carriage and/or the second carriage being moved in translation when the two retaining means are adjusted away from their retaining position in that the first retaining means is moved in translation with the first carriage and/or the second retaining means is moved in translation with the second carriage. Thus, the slide is operatively connected to the first carriage and the second carriage such that, when the two retaining means are adjusted away from their retaining position, the slide is moved in that the first retaining means is moved in translation with the first carriage and/or the second retaining means is moved in translation with the second carriage. In this case, for the movement of the slide, it is irrelevant whether only the first retaining means is moved with the first carriage, whether only the second retaining means is moved with the second carriage, or whether both the first retaining means is moved with the first carriage and the second retaining means is moved with the second carriage. Preferably, in this case, the movement of the slide is a movement in translation.

The slide has the advantage that the adjustment of the two retaining means away from their retaining position can be controlled easily. For example, the slide can be preloaded by an elastic element, with the result that the two retaining means are preloaded towards their retaining position, or can be moved away from their retaining position only counter to the preloading of the elastic element.

Preferably, the first carriage and the second carriage are movable in translation by a movement of the slide. This has the advantage that the two retaining means can be configured to be adjustable easily between their retaining position and their step-in position and that in this way the movement of the two retaining means can be controlled by means of the slide. Alternatively, however, it is also possible for the first carriage and the second carriage not to be movable in translation by a movement of the slide.

Preferably, the first carriage has a first guiding form and the second carriage has a second guiding form, wherein the slide has a third guiding form and a fourth guiding form, wherein the first guiding form cooperates with the third guiding form and the second guiding form cooperates with the fourth guiding form. This has the advantage that an optimal operative connection can be achieved between the slide and the first carriage and the slide and the second carriage. In order to achieve this advantage, it is irrelevant whether the third guiding form and the fourth guiding form are separated from one another or merge seamlessly into one another.

Alternatively, it is also possible for the slide to cooperate with the first carriage via a first pivot joint and with the second carriage via a second pivot joint. In this case, the first and the second pivot joint can for example each be a lever element that is mounted on the slide so as to be pivotable about a first pivot axis and on the first or second carriage so as to be pivotable about a second pivot axis spaced apart from the first pivot axis.

Advantageously, the slide is mounted so as to be movable in translation in the longitudinal direction of the ski, and the first carriage and the second carriage are mounted so as to be movable in translation substantially horizontally in the transverse direction of the ski. Thus, the first carriage and the second carriage are mounted so as to be movable in translation preferably in one direction at an inclination of at most 45°, particularly preferably at most 20°, very particularly preferably at most 10° and most preferably in a horizontally oriented plane. This has the advantage that the slide and the two carriages can be arranged in a space-saving manner.

Alternatively, however, it is also possible for the slide to be mounted so as to be movable in translation in another direction, for example in the transverse direction of the ski. Equally, it is also possible for the first carriage and the second carriage to be mounted so as to be movable substantially horizontally in another direction than in the transverse direction of the ski.

Preferably, as a result of the slide being moved in translation in a first direction in the longitudinal direction of the ski, the first carriage and the second carriage are movable relative to one another and thus the first retaining means and the second retaining means are movable towards one another, towards their retaining position. Thus, the slide is preferably operatively connected to the first carriage and the second carriage such that, as a result of a movement of the slide in the first direction in the longitudinal direction of the ski, the first carriage and the second carriage are moved relative to one another and as a result the first retaining means and the second retaining means are moved towards one another, towards their retaining position. This has the advantage that the two retaining means are movable easily into their retaining position. Alternatively, however, it is also possible for the two retaining means to be movable into their retaining position not by the slide being moved but in some other way.

If the first carriage has a first guiding form, the second carriage has a second guiding form, and the slide has a third guiding form and a fourth guiding form, wherein the first guiding form cooperates with the third guiding form and the second guiding form cooperates with the fourth guiding form, the slide is preferably operatively connected to the first carriage as a result of the cooperation of the first guiding form with the third guiding form, and operatively connected to the second carriage as a result of the cooperation of the second guiding form with the fourth guiding form. If, in this case, the slide is moved in translation, preferably the first guiding form is moved in translation with respect to the third guiding form and/or the second guiding form is moved in translation with respect to the fourth guiding form.

Preferably, the slide is operatively connected to the first carriage and the second carriage such that, as a result of a movement of the first carriage and the second carriage relative to one another, during which the two retaining means are moved apart away from their retaining position, the slide is moved in a second direction opposite to the first direction. This has the advantage that, as a result of a force acting on the slide, which can be generated for example by a preloaded elastic element, the two carriages can be preloaded relative to one another and as a result the two retaining means can be preloaded towards one another, towards their retaining position. This has the advantage that an abovementioned safety release can be allowed for example in a simple manner.

Alternatively, however, it is also possible for the slide not to be operatively connected to the first carriage and the second carriage such that, as a result of a movement of the first carriage and the second carriage relative to one another, during which the two retaining means are moved apart away from their retaining position, the slide is moved in a second direction opposite to the first direction.

As an alternative to the abovementioned variants, it is also possible for the automatic front unit not to comprise a first carriage and a second carriage, wherein the first retaining means is arranged on the first carriage and the second retaining means is arranged on the second carriage, wherein the first carriage is mounted so as to be movable in translation and the second carriage is mounted so as to be movable in translation, with the result that the two retaining means, in order to be adjusted from their step-in position into their retaining position and back again, are mounted so as to be movable in translation relative to one another along the adjustment path in that the first retaining means is mounted so as to be movable in translation by the first carriage and the second retaining means is mounted so as to be movable in translation by the second carriage.

Advantageously, the automatic front unit has a preloaded elastic element, the preloading of which causes the two retaining means to be loaded towards their retaining position with a retaining force in the first retaining configuration of the automatic front unit. Preferably, the elastic element is a spring, particularly preferably a spiral spring. In variants, however, it is also possible for the automatic front unit not to comprise an elastic element or for the elastic element to be formed in some other way. For example, the elastic element can also be formed by a block of an elastic material.

Preferably, the elastic element is oriented in the longitudinal direction of the ski. In a preferred variant thereof, the elastic element is arranged, as seen in the longitudinal direction of the ski, in front of a straight line, oriented in the transverse direction of the ski, that extends through the first retaining means and through the second retaining means. This has the advantage that the elastic element can be arranged in front of the ski boot possibly retained in the automatic front unit. Since there is more free space there, a larger elastic element can be inserted, and so a greater retaining force can be achieved, with which the two retaining means are preloaded towards their retaining position in the first retaining configuration of the automatic front unit. In a further preferred variant, the elastic element is arranged, as seen in the longitudinal direction of the ski, behind the straight line, oriented in the transverse direction of the ski, that extends through the first retaining means and through the second retaining means. This has the advantage that the automatic front unit can be designed in a more visually compact manner, since the elastic element can be arranged beneath the ski boot possibly retained in the automatic front unit, and so the automatic front unit has less volume in front of the ski boot.

Alternatively, it is also possible for the elastic element to be oriented in some other way.

Preferably, the preloading of the elastic element is settable. This has the advantage that a strength of the retaining force can be set. Alternatively, however, it is also possible for the preloading of the elastic element to be predefined and thus not settable. Such an alternative has the advantage that the automatic front unit can be constructed more simply.

Preferably, the automatic front unit has an adjustable opening lever for adjusting the automatic front unit from the first retaining configuration into the step-in configuration. This has the advantage that it is easier to operate the automatic front unit. Preferably, the automatic front unit is in this case adjustable from the first retaining configuration into the step-in configuration by the adjustable opening lever. Particularly preferably, the automatic front unit is adjustable from the first retaining configuration into the step-in configuration and back again by the adjustable opening lever.

Alternatively, however, it is also possible for the automatic front unit not to have such an opening lever.

Advantageously, the automatic front unit comprises a blocking element that is adjustable between a blocking position and a releasing position, and has a second retaining configuration, in which the two retaining means are in the retaining position and in which the blocking element is in the blocking position, wherein the blocking element, in the blocking position, prevents the adjustment of the automatic front unit into the step-in configuration and the possibly present release configuration. This has the advantage that, when the automatic front unit is employed in a touring ski binding and is used in its second retaining configuration in the step-in position of the touring ski binding, accidental detachment of the ski boot from the automatic front unit can be prevented. Preferably, in the first retaining configuration of the automatic front unit, the blocking element is in the release position. This has the advantage that, when the automatic front unit is employed in a touring ski binding and is used in its first retaining configuration in the downhill position of the touring ski binding, a safety release can be allowed if the skier falls.

If the automatic front unit has an adjustable opening lever, the automatic front unit is preferably adjustable from the second retaining configuration into the step-in configuration by the adjustable opening lever. Preferably, the automatic front unit is additionally adjustable from the first retaining configuration into the second retaining configuration and back again by the adjustable opening lever. This has the advantage that it is easier to operate the automatic front unit.

Alternatively, it is also possible for the automatic front unit not to comprise such a blocking element and accordingly not to have such a second retaining configuration.

Preferably, the automatic front unit comprises a tread spur to be actuated by a ski boot to be inserted into the automatic front unit, wherein, as a result of the tread spur being actuated, the automatic front unit is adjustable from its step-in position into its first retaining configuration or into its second retaining configuration. This has the advantage that it is easier for the skier to step into the automatic front unit in that, when the automatic front unit is in the step-in configuration, the ski boot can be positioned correctly relative to the two retaining means for the purpose of stepping in, after which the tread spur can be actuated with the ski boot in order to adjust the automatic front unit into the first retaining configuration or into the second retaining configuration and in order to retain the ski boot in the automatic front unit.

Alternatively, however, it is also possible for the automatic front unit not to comprise such a tread spur.

Preferably, the automatic front unit comprises a ski boot release actuating element, which has an activated position, in which the ski boot release actuating element is in the first retaining configuration of the automatic front unit and in which the ski boot release actuating element is actuable, in particular by the ski boot retained in the automatic front unit being pivoted, in order to move the two retaining means at least temporarily away from their retaining position and away from one another and as a result to release a ski boot optionally retained in the automatic front unit. This has the advantage that the safety for the skier is increased because if the skier falls forward, the ski boot is released from the automatic front unit.

If the automatic front unit also comprises a blocking element that is adjustable between a blocking position and a release position and has a second retaining configuration in which the two retaining means are in the retaining position and in which the blocking element is in the blocking position, wherein the blocking element, in the blocking position, prevents the adjustment of the automatic front unit into the step-in configuration and the possibly present release configuration, the blocking element and the ski boot release actuating element can be formed together in one piece or as two separate pieces. When the blocking element and the ski boot release actuating element are formed together in one piece, the ski boot release actuating element preferably has a deactivated position in which, when the automatic front unit is in the second retaining configuration, actuation of the ski boot release actuating element for moving the two retaining means away from one another is blocked by the blocking element in that the blocking element is in the blocking position. Particularly preferably, in this case, the ski boot release actuating element is mounted so as to be pivotable about a pivot axis and to be adjustable between its activated position and its deactivated position by a pivoting movement about the pivot axis. The ski boot release actuating element can, however, also be mounted in some other way, for example so as to be movable in translation, and be adjustable between its activated position and its deactivated position.

Advantageously, in the first retaining configuration of the automatic front unit, when the ski boot release actuating element is in its activated position, the opening lever is actuable by actuation of the ski boot release actuating element, in particular by pivoting the ski boot retained in the automatic front unit, in order to adjust the automatic front unit at least temporarily away from its first retaining configuration and in order to move the two retaining means at least temporarily away from their retaining position and away from one another and as a result to release a ski boot optionally retained in the automatic front unit. This has the advantage that the automatic front unit can be of simple construction.

Preferably, a ski binding comprises an automatic front unit according to the invention.

Preferably, a ski comprises such a ski binding having an automatic front unit according to the invention.

Further advantageous embodiments and combinations of features of the invention can be gathered from the following detailed description and from the claims, taken in their entirety.

BRIEF DESCRIPTION OF THE DRAWINGS

In the drawings used to explain the exemplary embodiment.

In all cases, identical parts are provided with identical reference signs in the figures.

Ways of Implementing the Invention

Figure 1A:
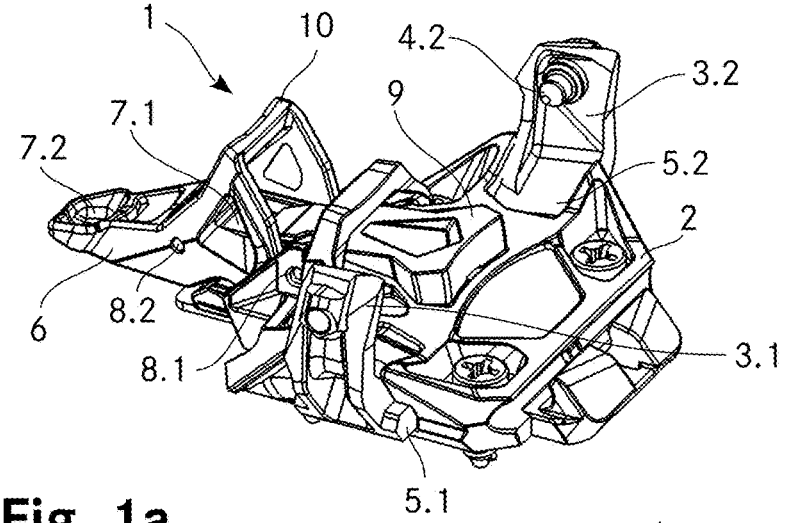
FIGS. 1*a, b, c* each show an oblique view of an automatic front unit according to the invention, wherein the automatic front unit is shown in a step-in configuration, in a first retaining configuration and in a second retaining configuration, respectively.
Figure 1B:
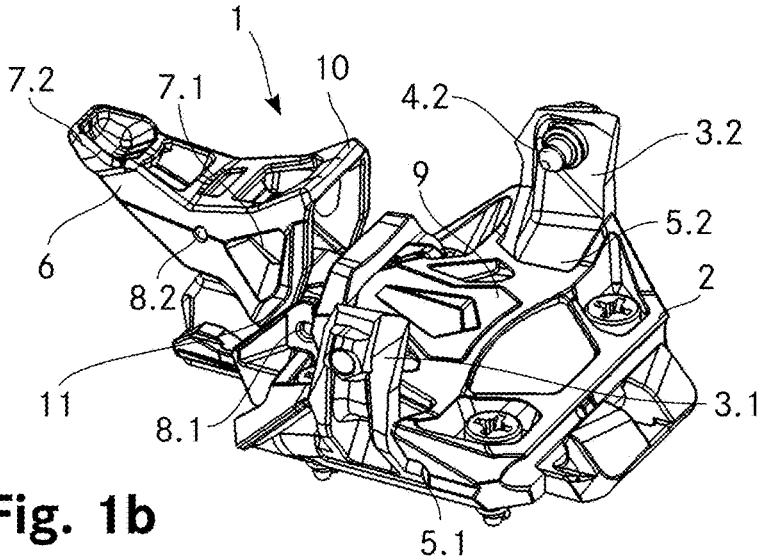
Figure 1C:
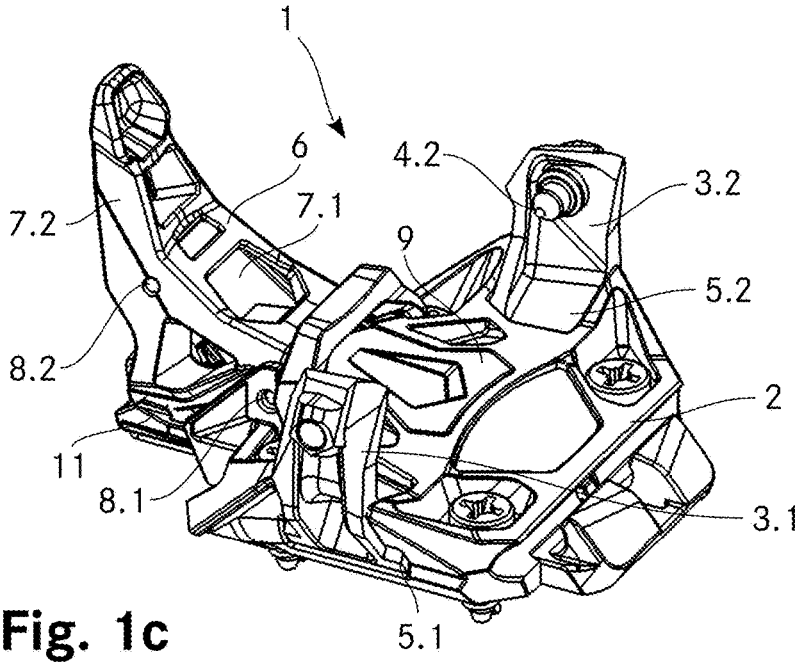

FIGS. 1*a*, 1*b* and 1*c* each show an oblique view of an automatic front unit 1 according to the invention. In this case, the front of the automatic front unit 1 is located at the top left in the figures, while the rear is located at the bottom right in the figures. Furthermore, the top and bottom of the automatic front unit 1 are likewise at the top and bottom, respectively, in the figures.

In FIG. 1*a*, the automatic front unit 1 is shown in a step-in configuration. By contrast, in FIG. 1*b*, the automatic front unit 1 is shown in a first retaining configuration, while the automatic front unit 1 is illustrated in a second retaining configuration in FIG. 1*c*.

The automatic front unit 1 comprises a housing 2, which is fastenable to a ski (not shown here) by means of screws in order to fasten the automatic front unit 1 to the ski. Furthermore, the automatic front unit 1 has a first retaining lever 3.1 and a second retaining lever 3.2, which are arranged opposite one another on either side of the centre of the ski. These two retaining levers 3.1, 3.2 are arranged in a substantially vertically oriented manner and oriented in a manner pointing upwards in the step-in configuration, in the first retaining configuration and in the second retaining configuration of the automatic front unit 1. Arranged in an upper region of the first retaining lever 3.1 is a first retaining means 4.1 for retaining a ski boot (not shown here), while a second retaining means 4.2 for retaining the ski boot (not shown here) is arranged in an upper region of the second retaining lever 3.2. Each of the retaining means 4.1, 4.2 is a frustoconical stud, pointing towards the centre of the ski, which, in order to retain the ski boot, can engage in recesses provided for this purpose that are arranged laterally in the toe region of a ski boot.

The first retaining lever 3.1 is formed in one piece with a first carriage 5.1, wherein the first carriage 5.1 is mounted in the housing 2 so as to be movable in translation horizontally in the transverse direction of the ski. Analogously thereto, the second retaining lever 3.2 is also formed in one piece with a second carriage 5.2, wherein the second carriage 5.2 is likewise mounted in the housing 2 so as to be movable in translation horizontally in the transverse direction of the ski. The two pieces are manufactured from cast aluminium and formed in a rigid manner. In this case rigid means that, when an external force acts thereon, the respective piece bends elastically by at most a limit value without the piece breaking. In order to determine this limit value, the starting point is two points in the respective piece, wherein the first point is located in the carriage 5.1, 5.2 in the region of the carriage 5.1, 5.2 in which the carriage 5.1, 5.2 is mounted in the housing 2 so as to be movable in translation, and wherein the second point is located in the retaining lever 3.1, 3.2 at the location at which the retaining means 4.1, 4.2 belonging to the retaining lever 3.1, 3.2 is arranged. In this case, the rest distance is assumed to be the distance between the two points when an external force is not acting on the piece. Furthermore, one of the two points is fixed in space, while the translation distance of the position of the other point in space without an external force acting on the piece is determined using the position of this other point in space when an external force is acting on the piece. In this case, for each possible pair of points and each possible acting force, in the respective piece, the translation distance is 0.01% or less. In variants, this percentage is 0.1% or less, or 1% or less.

The automatic front unit 1 furthermore comprises an opening lever 6 for adjusting the automatic front unit 1 from the first retaining configuration into the step-in configuration and back again, and for adjusting the automatic front unit 1 from the first retaining configuration into the second retaining configuration and back again. The opening lever 6 consists of a first lever element 7.1 and a second lever element 7.2. The first lever element 7.1 is mounted on the housing 2 so as to be pivotable about a first pivot axis 8.1 and points with its free end forward and upward. The second lever element 7.2 is mounted so as to be pivotable about a second pivot axis 8.2, which is located in the region of the free end of the first lever element 7.1. Furthermore, the automatic front unit 1 comprises a tread spur 9 for adjusting the automatic front unit 1 from the step-in configuration into the retaining configuration, wherein the tread spur 9 is likewise mounted so as to be pivotable about the first pivot axis 8.1. The tread spur 9 extends with its free end towards the rear as far as under the two retaining means 4.1, 4.2.

As mentioned above, the automatic front unit 1 is illustrated in the step-in configuration in FIG. 1*a*. In this case, the two carriages 5.1, 5.2 have been moved in translation away from one another in the transverse direction of the ski. Accordingly, the two retaining arms 3.1, 3.2 with the two retaining means 4.1, 4.2 have also been moved away from one another. The two retaining means 4.1, 4.2 are thus at a second spacing from one another. This is a step-in position of the two retaining means 4.1, 4.2. In this step-in position, the ski boot is released from the two retaining means 4.1, 4.2 and can be moved away from the retaining means 4.1, 4.2 and thus also away from the automatic front unit 1. Equally, however, in the step-in configuration of the automatic front unit 1, a ski boot can be moved towards the automatic front unit 1 and with its toe region between the two retaining means 4.1, 4.2 in order to step into the automatic front unit 1.

As is apparent in FIG. 1*a*, in the step-in configuration of the automatic front unit 1, the tread spur 9 has been pivoted somewhat upwards with its rearwardly pointing free end. In addition, the opening lever 6 has been pivoted downwards with its forwardly pointing free end. The latter means that the first lever element 7.1 has been pivoted downwards towards the ski with its forwardly pointing free end and thus with the second pivot axis 8.2, while the second lever element 7.1 has likewise been pivoted downwards towards the ski with its forwardly pointing free end.

In order to adjust the automatic front unit 1 from the step-in configuration shown in FIG. 1*a* into the first retaining configuration shown in FIG. 1*b*, the opening lever 6 can be pulled upwards slightly with its free end or the tread spur 9 can be pushed downwards with its rearwardly pointing free end. The latter makes it possible in particular to step into the automatic front unit 1, since, with the automatic front unit 1 in the step-in configuration, a ski boot can be moved with its toe region between the two retaining means 4.1, 4.2 until it is positioned correctly with respect to the retaining means 4.1, 4.2, after which the ski boot can be moved downwards slightly, with the result that the tread spur 9 is pushed downwards and the automatic front unit 1 is adjusted into its first retaining configuration.

As is apparent in FIG. 1*b*, in the first retaining configuration of the automatic front unit 1, the opening lever 6 has been pivoted upwards slightly with its free end. In addition, the tread spur 9 has been pivoted downwards with its rearwardly pointing free end and has an upwardly pointing surface that is oriented flush with the surrounding, upwardly pointing surface of the housing 2. Furthermore, the two carriages 5.1, 5.2 have been moved in translation towards one another, and thus the two retaining levers 3.1, 3.2 with the retaining means 4.1, 4.2 have also been moved towards one another. In this case, the two retaining means 4.1, 4.2 are at a first spacing from one another, which is smaller than the second spacing. This is a retaining position of the two retaining means 4.1, 4.2. In this retaining position, the two retaining means 4.1, 4.2 can engage in recesses arranged laterally in the toe region of the ski boot and as a result retain the ski boot on the automatic front unit 1 so as to be pivotable about an axis oriented horizontally in the transverse direction of the ski.

On account of the two carriages 5.1, 5.2, the two retaining means 4.1, 4.2, in order to be adjusted from their step-in position into their retaining position and back again, are mounted so as to be movable in translation relative to one another along an adjustment path, wherein a region of the adjustment path adjoining the retaining position of the two retaining means is oriented horizontally in the transverse direction of the ski. In the present exemplary embodiment, this region of the adjustment path extends along the entire adjustment path of the two retaining means 4.1, 4.2 from the retaining position into the step-in position. In other embodiments, by contrast, the region has a length of for example 30%, 55% or 80% of a length of the adjustment path.

In order to adjust the automatic front unit 1 from the first retaining configuration shown in FIG. 1*b* back into the step-in configuration, the opening lever 6 can be pushed downwards towards the ski with its forwardly pointing end. This can be carried out manually or in that a ski boot retained in the automatic front unit 1 is pivoted forwards and upwards with its heel region such that the upper toe region of the ski boot is pivoted forwards and downwards and as a result pushes the opening lever 6 downwards. In order to allow such adjustment by the ski boot, the second lever element 7.2 of the opening lever 6 has a ski boot release actuating element 10 in its upper rear region. In the first retaining configuration of the automatic front unit 1, this ski boot release actuating element 10 is in an activated position, in which it is actuable by pivoting of the ski boot retained in the automatic front unit 1, in order to move the two retaining means 4.1, 4.2 at least temporarily away from their retaining position and away from one another and as a result to release a ski boot possibly retained in the automatic front unit 1 when the ski boot is pivoted forwards and upwards with its heel region and thus the upper toe region of the ski boot is pivoted forwards and downwards.

As is apparent in FIG. 1*c*, in the second retaining configuration of the automatic front unit 1, the opening lever 6 has been pivoted further upwards with its free end than in the first retaining configuration of the automatic front unit 1. In this case, the first lever element 7.1 has scarcely noticeably been pivoted further upwards than in the first retaining configuration and the retaining means 4.1, 4.2 are in their retaining position as already in the first retaining configuration. The second lever element 7.2, however, has been pivoted much further upwards about the second pivot axis 8.2 with its forwardly pointing free end than in the first retaining configuration. As a result, the ski boot release actuating element 10 has been pivoted out of the movement path of the ski boot retained in the automatic front unit 1 and thus into a deactivated position. Moreover, as a result, a blocking element 11, which is arranged on the second lever element 7.2 of the opening lever 6 in the rear lower region of the second lever element 7.2, has been pivoted under the second pivot axis 8.2, where it is supported from beneath. In this way, the blocking element 11 is in a blocking position, in which it prevents the first lever element 7.1 of the opening lever 6 from pivoting downwards and the automatic front unit 1 from being able to be unintentionally adjusted into the step-in configuration. Compared therewith, the blocking element 11 in the first retaining configuration of the automatic front unit 1 has been pivoted rearwardly and upwardly about the second pivot axis 8.2 into a release position.

Figure 2:
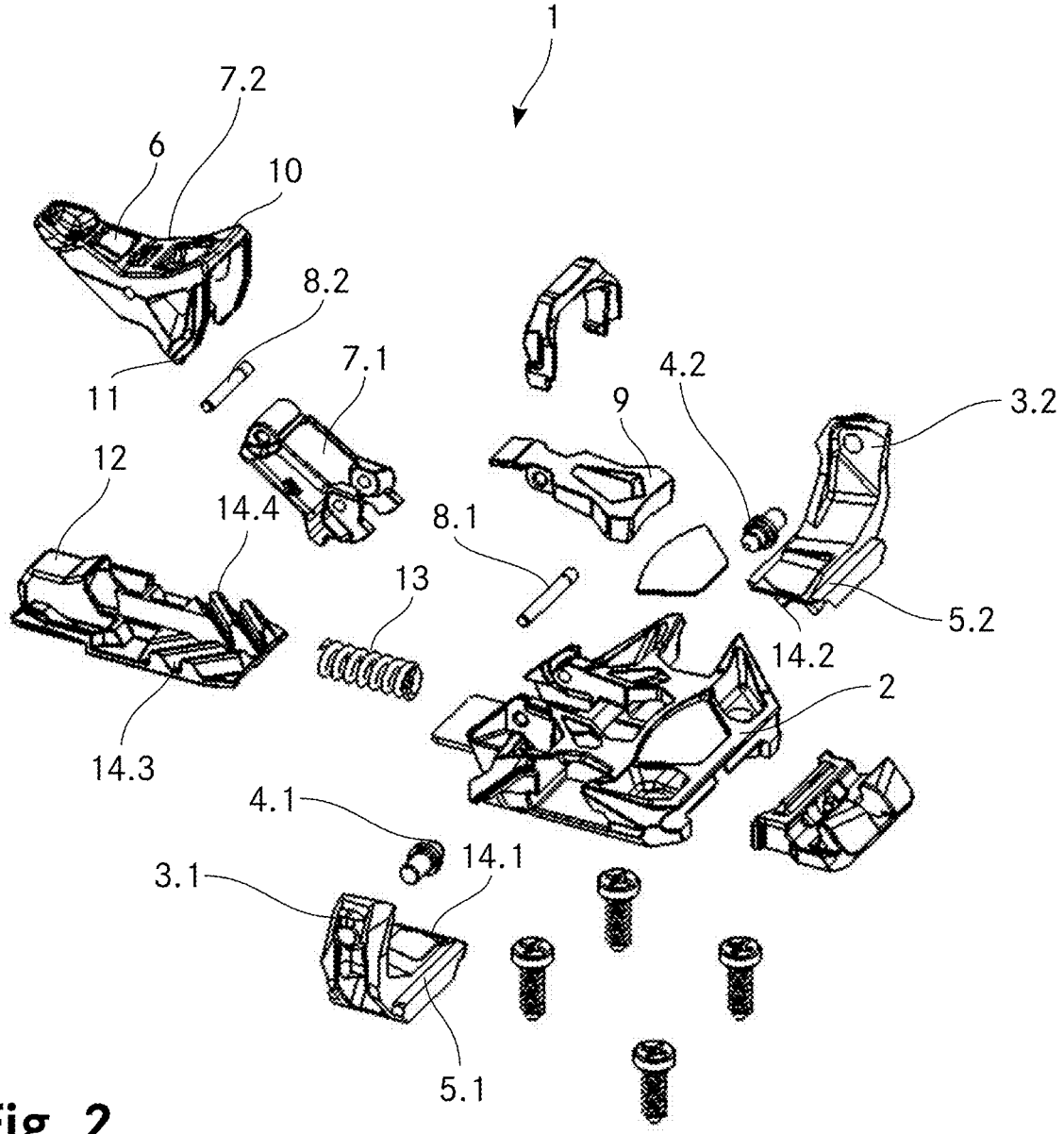
FIG. 2 shows an exploded illustration of the automatic front unit in an oblique view, FIGS. 3*a, b, c* each show a cross-sectional illustration of a vertically oriented cross section extending through the automatic front unit in the longitudinal direction of the ski, wherein the automatic front unit is shown in the step-in configuration, in the first retaining configuration and in the second retaining configuration, respectively, FIGS. 4*a, b* each show a cross-sectional illustration of a vertically oriented cross section extending through the automatic front unit in the transverse direction of the ski, wherein the automatic front unit is shown in the step-in configuration and in the first retaining configuration, respectively, and FIGS. 5*a, b, c* each show a simplified, schematic cross-sectional illustration of a vertically oriented cross section extending through a further automatic front unit according to the invention in the transverse direction of the ski, wherein the automatic front unit is shown in the first retaining configuration, in the step-in configuration and in a release configuration, respectively.

FIG. 2 shows an oblique view of an exploded illustration of the automatic front unit 1. In this case the front of the automatic front unit 1 is again located at the top left in the figure, while the rear is located at the bottom right in the figure.

It is apparent from the exploded illustration that the automatic front unit 1 additionally comprises a slide 12 and an elastic element 13 in the form of a spiral spring. Both the slide 12 and the elastic element 13 are oriented in the longitudinal direction of the ski and are arranged in the housing 2 in the assembled state of the automatic front unit 1. In this case, the elastic element 13 is arranged as seen in the longitudinal direction of the ski in front of a line oriented horizontally in the transverse direction of the ski and extending through the two retaining means 4.1, 4.2. Towards the rear, the elastic element 13 is supported on the housing 2 and to the front it is supported on the slide 12. In the assembled state of the automatic front unit 1, the elastic element 13 is preloaded and pushes the slide 12 forwards. In the embodiment shown here, the preloading of the elastic element 13 is defined by the shaping of the housing 2 and of the slide 12. In variants, the preloading of the elastic element 13 is settable, however. This can be achieved for example by means of a screw or a combination of a bolt and a nut, as is known from the technical field of ski bindings.

The slide 12 extends beneath the elastic element 13 towards the rear as far as under the two carriages 5.1, 5.2. In this case, the slide 12 has a third guiding form 14.3 beneath the first carriage 5.1 and a fourth guiding form 14.4 beneath the second carriage 5.2. Both the third guiding form 14.3 and the fourth guiding form 14.4 are formed by channels that extend diagonally to the side and the front from the centre of the ski. Furthermore, the first carriage 5.1 has a first guiding form 14.1 on its underside while the second carriage 5.2 has a second guiding form 14.2 on its underside. In this case the first guiding form 14.1 is formed in a complementary manner to the third guiding form 14.3, while the second guiding form 14.2 is formed in a complementary manner to the fourth guiding form 14.4. In the assembled state of the automatic front unit 1, the first guiding form 14.1 cooperates with the third guiding form 14.3, while the second guiding form 14.2 cooperates with the fourth guiding form 14.4. Thus, the slide 12 is operatively connected to the first carriage 5.1 as a result of the cooperation of the first guiding form 14.1 with the third guiding form 14.3 and is operatively connected to the second carriage 5.2 as a result of the cooperation of the second guiding form 14.2 with the fourth guiding form 14.4. When the slide 12 is thus moved in translation, the first guiding form 14.1 is moved in translation with respect to the third guiding form 14.3 and the second guiding form 14.2 is moved in translation with respect to the fourth guiding form 14.4. Therefore, as a result of the slide 12 being moved in translation in a first direction in the longitudinal direction of the ski, the first carriage 5.1 and the second carriage 5.2 are moved in translation relative to one another, with the result that the first retaining means 4.1 and the second retaining means 4.2 are also moved towards one another, towards their retaining position. In this case, however, the slide 12 is operatively connected to the first carriage 5.1 and the second carriage 5.2 such that, as a result of a movement of the first carriage 5.1 and of the second carriage 5.2 relative to one another, during which the two retaining means 4.1, 4.2 are moved apart away from their retaining position, the slide 12 is moved in a second direction opposite to the first direction. At the same time, as a result of the slide 12 being moved in translation in the second direction opposite to the first direction, the first carriage 5.1 and the second carriage 5.2 are moved in translation relative to one another, with the result that the first retaining means 4.1 and the second retaining means 4.2 are moved away from one another away from their retaining position.

Figure 3A:
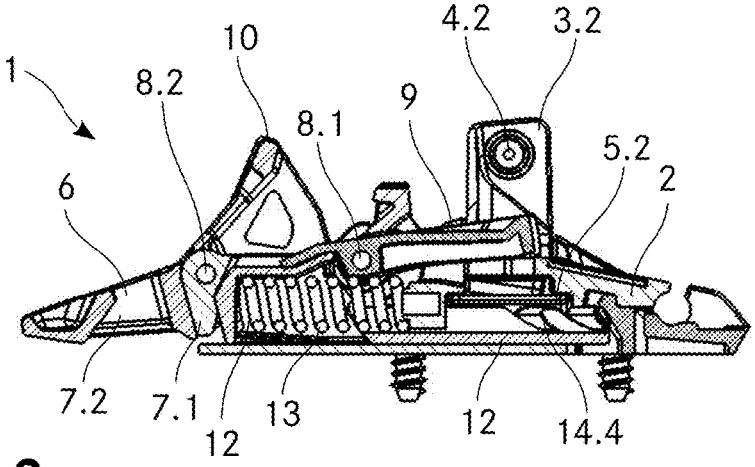
Figure 3B:
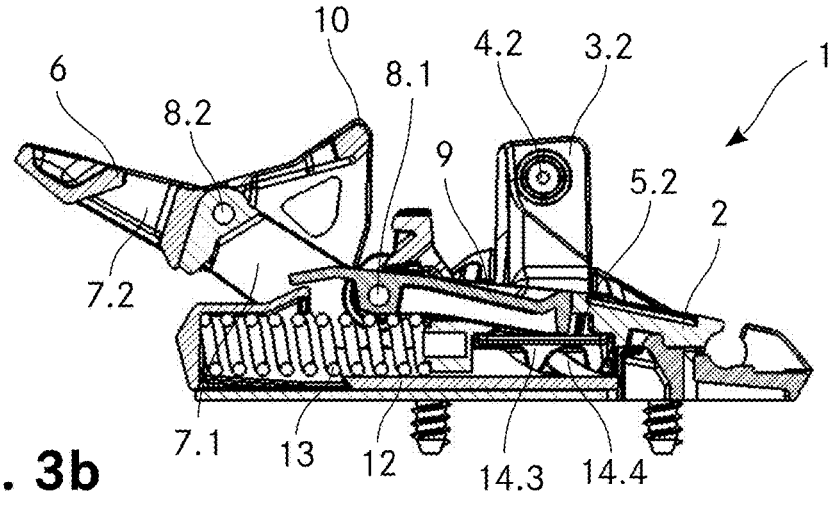
Figure 3C:
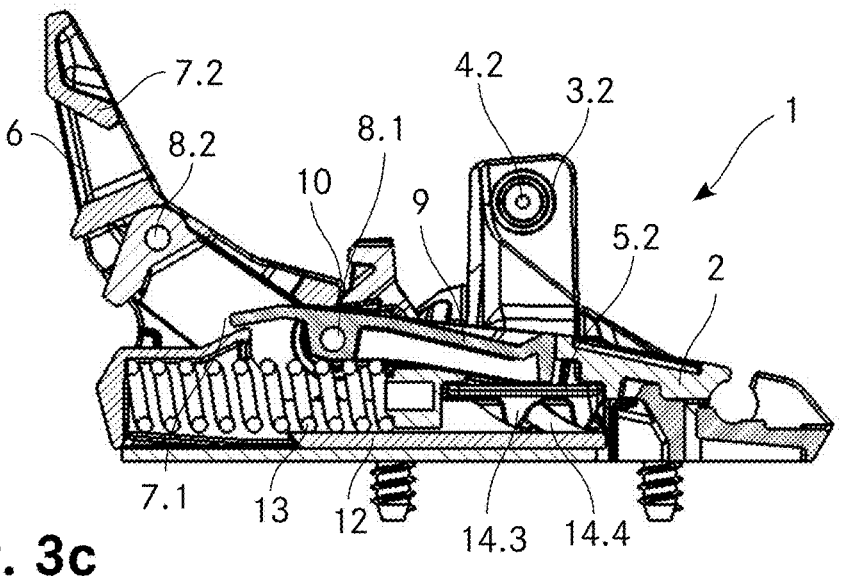

FIGS. 3*a*, 3*b* and 3*c* each show a cross-sectional illustration of a vertically oriented cross section extending through the automatic front unit 1 in the longitudinal direction of the ski. In FIG. 3*a*, the automatic front unit 1 is shown in the step-in configuration, while the automatic front unit 1 is shown in the first retaining configuration in FIG. 3*b* and in the second retaining configuration in FIG. 3*c*.

It is apparent from FIG. 3*a* that, in the step-in configuration of the automatic front unit 1, the first lever element 7.1 of the opening lever 6 has been pivoted forwards from top to bottom over the front region of the slide 12 and thus holds the slide 12 in a position pushed towards the rear counter to the preloading generated by the elastic element 13. As a result, the two carriages 5.1, 5.2 are also held in a correspondingly moved-apart position, with the result that the two retaining means 4.1, 4.2 are held in their step-in position.

If the opening lever 6 is now pulled upwards, the slide 12 is released and moved forwards, with the result that the automatic front unit 1 is adjusted into its first retaining configuration. To this end, the opening lever 6 can be pulled upwards manually or the tread spur 9 can be pushed downwards with its rearwardly pointing free end. In the latter case, a region of the tread spur 9 that is located in front of the first pivot axis 8.1 presses from the bottom upwards against the first lever element 7.1 of the opening lever 6, with the result that the opening lever 6 is pivoted upwards.

As a result of the opening lever 6 being moved upwards, the slide 12, as mentioned above, is moved forwards. This movement of the slide 12 is brought about by the preloaded elastic element 13, which pushes the slide 12 forwards. Furthermore, however, this movement of the slide 12 is also brought about by a coupling of the opening lever 6 to the slide 12. To this end, as is apparent from the exploded illustration in FIG. 2, the first lever element 7.1 has, in the region beneath the first pivot axis 8.1, two cams that engage in corresponding recesses in the slide 12 in the assembled state of the automatic front unit 1. In this way, the movement of the slide 12 is coupled to a pivoting movement of the first lever element 7.1. Therefore, if, during the adjustment of the automatic front unit 1 from the step-in configuration into the first retaining configuration, the opening lever 6 is pulled manually upwards and in the process the first lever element 7.1 is pivoted upwards about the first pivot axis 8.1, the slide 12 is pulled forwards. Equally, however, the first lever element 7.1 and thus the opening lever 6 are also moved upwards by the slide 12 when, on account of the preloading of the elastic element 13, the slide 12 is pushed forwards. On account of this cam connection, the slide 12 is also pushed towards the rear counter to the preloading of the elastic element 13 when the opening lever 6 and the first lever element 7.1 are pivoted downwards in order to adjust the automatic front unit 1 from the first retaining configuration into the step-in configuration. In the step-in configuration, the automatic front unit 1 remains held because the first lever element 7.1 has been pivoted forwards from top to bottom over the rearwardly pushed slide 12 and, on account of the shaping of the front end of the slide 12, which is pushed against corresponding shaping on the first lever element 7.1, is held in a latched position.

Figure 4A:
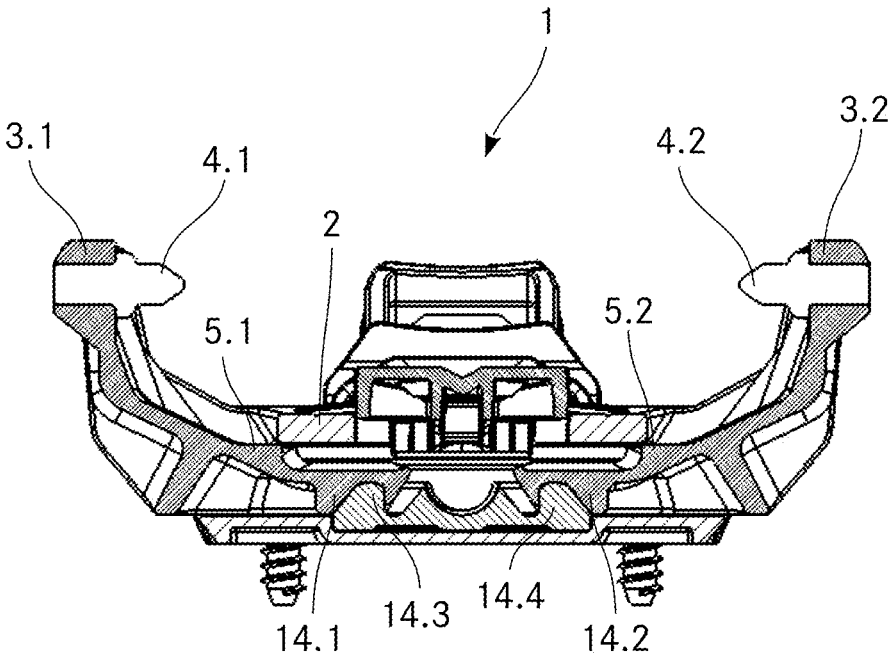
Figure 4B:
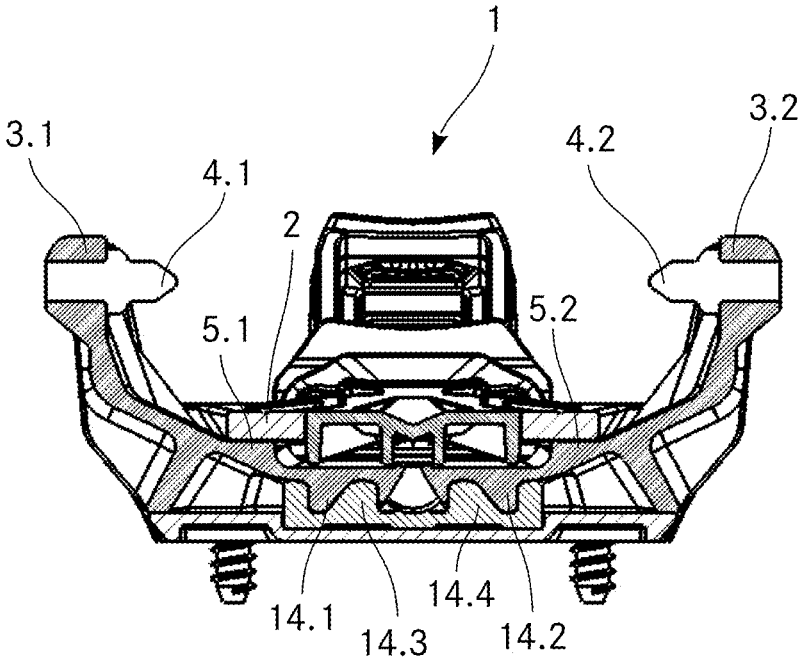

FIGS. 4*a* and 4*b* each show a cross-sectional illustration of a vertically oriented cross section extending through the automatic front unit 1 in the transverse direction of the ski. In this case, the automatic front unit 1 is shown in the step-in configuration in FIG. 4*a* and in the first retaining configuration in FIG. 4*b*. Thus, the two retaining means 4.1, 4.2 are shown in the step-in configuration in FIG. 4*a*, while they are shown in the retaining position in FIG. 4*b*.

Figure 5A:
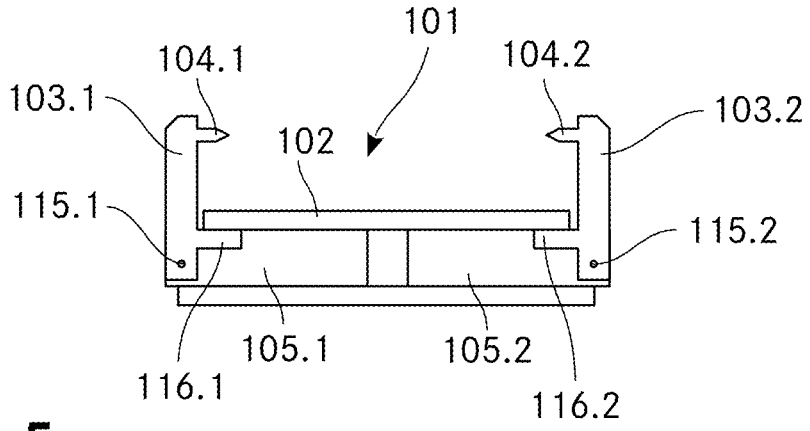
Figure 5B:
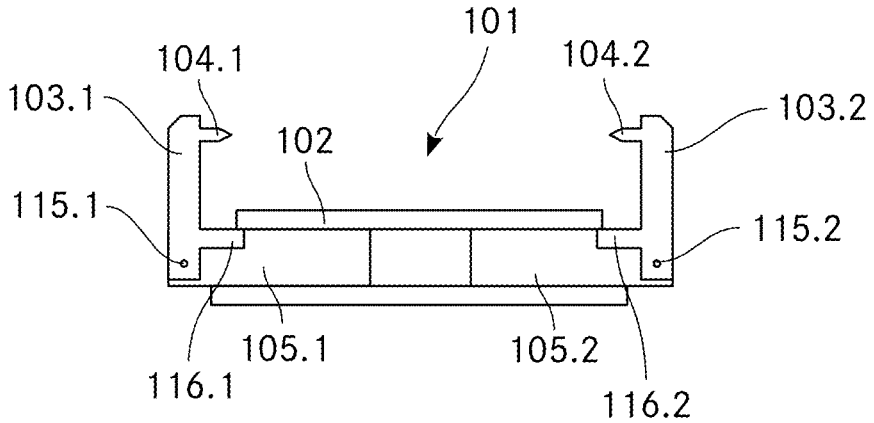
Figure 5C:
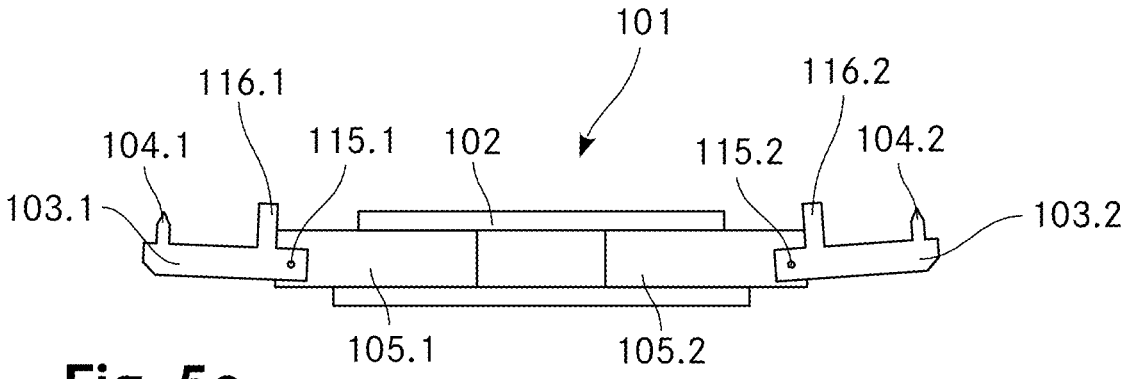

FIGS. 5*a*, 5*b* and 5*c* each show a simplified, schematic cross-sectional illustration of a vertically oriented cross section extending through a further automatic front unit 101 according to the invention in the transverse direction of the ski. The automatic front unit 101 shown in FIGS. 5*a*, 5*b* and 5*c* is of substantially identical construction to the automatic front unit 1 shown in FIGS. 1*a* to 4*b*. However, in contrast to the automatic front unit 1 illustrated in FIGS. 1*a* to 4*b*, in the case of the automatic front unit 101 illustrated in FIGS. 5*a*, 5*b* and 5*c*, the retaining levers 103.1, 103.2 are configured as pieces that are separate from the carriages 105.1, 105.2. In this case, the first retaining lever 103.1 is mounted on the first carriage 105.1 so as to be pivotable about a first axis 115.1, while the second retaining lever 103.2 is mounted on the second carriage 105.2 so as to be pivotable about a second axis 115.2.

In FIG. 5*a*, the automatic front unit 101 is illustrated in the first retaining configuration. In this case, the two retaining means 104.1, 104.2 are in their retaining position. It is apparent from FIG. 5*a* that a lever blocking means 116.1, 116.2, which is supported on the housing 102 of the automatic front unit 1, is arranged on each of the retaining levers 103.1, 103.2. Thus, the lever blocking means 116.1, 116.2 are in a lever blocking position, in which they block a pivoting movement of the retaining levers 103.1, 103.2 with their retaining means 104.1, 104.2 away from the centre of the ski about the respective axis 115.1, 115.2 relative to the respective carriage 105.1, 105.2.

In FIG. 5*b*, the automatic front unit 101 is illustrated in the step-in configuration and the two retaining means 104.1, 104.2 are in their step-in position. Here, too, the lever blocking means 116.1, 116.2 are supported on the housing 102 and are in the lever blocking position, in which they block a pivoting movement of the retaining levers 103.1, 103.2 with their retaining means 104.1, 104.2 away from the centre of the ski about the respective axis 115.1, 115.2 relative to the respective carriage 105.1, 105.2.

In FIG. 5*c*, the automatic front unit 101 is illustrated in a release configuration, in which the lever blocking means 116.1, 116.2 are in a lever release position, in which a pivoting movement of the retaining levers 103.1, 103.2 about their axes 115.1, 115.2 is enabled and in which the retaining levers 103.1, 103.2 with the retaining means 104.1, 104.2 have also been pivoted away from the centre of the ski about the axes 115.1, 115.2.

In order to be adjusted from the first retaining configuration (see FIG. 5*a*) into the release configuration (see FIG. 5*b*) a sufficiently large load on the retaining means 104.1, 104.2, by which the retaining means 104.1, 104.2 are pushed apart, suffices. Such a load can arise for example when the skier falls. In this case, first of all the two carriages 105.1, 105.2 are moved away from the centre of the ski counter to the preloading of the elastic element. As soon as the carriages 105.1, 105.2 have been moved in translation sufficiently far, the lever blocking means 116.1, 116.2 are released from the housing 102 of the automatic front unit 101, with the result that the lever blocking means 116.1, 116.2 can be adjusted into their lever release position and the retaining levers 103.1, 103.2 with their retaining means 104.1, 104.2 can be pivoted away from the centre of the ski, with the result that the automatic front unit 101 is adjusted into its release configuration. As a result, the ski boot can be released in a safety release. Accordingly, the automatic front unit 101 shown in FIGS. 5*a*, 5*b* and 5*c* allows a safety release.

The invention is not limited to the two automatic front units 1, 101 described above. Various other variants and variations are possible.

In summary, it is noted that an automatic front unit has been created which is lightweight, can be produced cost effectively and affords the skier a greater level of safety.

The invention claimed is:

1. Automatic front unit for a ski binding, in particular a touring ski binding, wherein the automatic front unit comprises a first retaining means and a second retaining means for retaining a ski boot in the toe region of the ski boot, wherein the automatic front unit a) has a first retaining configuration, in which the two retaining means are in a retaining position, in which the two retaining means are at a first distance from one another, wherein the two retaining means can cooperate with the ski boot in the retaining position such that the ski boot is retained at the automatic front unit so as to be pivotable about an axis oriented horizontally in a transverse direction of the ski, and b) a step-in configuration, in which the two retaining means are in a step-in position, in which the two retaining means are at a second distance from one another, wherein the second distance is greater than the first distance and wherein the ski boot is released from the two retaining means in the step-in position of the two retaining means, wherein the automatic front unit is adjustable from the step-in configuration into the first retaining configuration and back again, wherein the two retaining means, in order to be adjusted from their step-in position into their retaining position and back again, are slidably mounted so as to be movable in translation relative to one another along an adjustment path, wherein a region of the adjustment path that adjoins the retaining position of the two retaining means extends the entire distance between the two retaining means and is oriented substantially horizontally.

2. Automatic front unit according to claim 1, wherein the automatic front unit has a first retaining lever and a second retaining lever, wherein the two retaining levers are arranged opposite one another on either side of the centre of the ski, wherein the first retaining means is arranged on the first retaining lever in an upper region of the first retaining lever and the second retaining means is arranged on the second retaining lever in an upper region of the second retaining lever.

3. Automatic front unit according to claim 1, wherein the two retaining means, in order to be adjusted from their step-in position into their retaining position and back again, are slidably mounted relative to one another along the adjustment path in that the first retaining means is slidably mounted and the second retaining means is slidably mounted.

4. Automatic front unit according to claim 3, wherein the automatic front unit comprises a first carriage and a second carriage, wherein the first retaining means is arranged on the first carriage and the second retaining means is arranged on the second carriage, wherein the first carriage is slidably mounted and the second carriage is slidably mounted, with the result that the two retaining means, in order to be adjusted from their step-in position into their retaining position and back again, are slidably mounted relative to one another along the adjustment path in that the first retaining means is slidably mounted by the first carriage and the second retaining means is slidably mounted by the second carriage.

5. Automatic front unit according to claim 4, wherein the automatic front unit comprises a slide, which is operatively connected to the first carriage and the second carriage and which is movable by the first carriage and/or the second carriage being moved in translation when the two retaining means are adjusted away from their retaining position in that the first retaining means is moved in translation with the first carriage and/or the second retaining means is moved in translation with the second carriage.

6. Automatic front unit according to claim 5, wherein the first carriage has a first guiding form, in that the second carriage has a second guiding form, and in that the slide has a third guiding form and a fourth guiding form, wherein the first guiding form cooperates with the third guiding form and the second guiding form cooperates with the fourth guiding form.

7. Automatic front unit according to claim 5, wherein the slide is slidably mounted in the longitudinal direction of the ski, and in that the first carriage and the second carriage are slidably mounted substantially horizontally in the transverse direction of the ski.

8. Automatic front unit according to claim 5, wherein, as a result of the slide being moved in translation in a first direction in the longitudinal direction of the ski, the first carriage and the second carriage are movable relative to one another and thus the first retaining means and the second retaining means are movable towards one another, towards their retaining position.

9. Automatic front unit according to claim 1, wherein the automatic front unit has a preloaded elastic element, the preloading of which causes the two retaining means to be preloaded towards their retaining position with a retaining force in the first retaining configuration of the automatic front unit.

10. Automatic front unit according to claim 9, wherein the elastic element is oriented in the longitudinal direction of the ski.

11. Automatic front unit according to claim 1, wherein the automatic front unit has an adjustable opening lever for adjusting the automatic front unit from the first retaining configuration into the step-in configuration.

12. Automatic front unit according to claim 1, wherein the automatic front unit comprises a blocking element that is adjustable between a blocking position and a releasing position, and has a second retaining configuration, in which the two retaining means are in the retaining position and in which the blocking element is in the blocking position, wherein the blocking element, in the blocking position, prevents the adjustment of the automatic front unit into the step-in configuration.

13. Automatic front unit according to claim 1, wherein the automatic front unit comprises a ski boot release actuating element, which has an activated position, in which the ski boot release actuating element is in the first retaining configuration of the automatic front unit and in which the ski boot release actuating element is actuable, in particular by the ski boot retained in the automatic front unit being pivoted, in order to move the two retaining means at least temporarily away from their retaining position and away from one another and as a result to release a ski boot optionally retained in the automatic front unit.

14. Ski binding having an automatic front unit according to claim 1.

15. Ski having a ski binding according to claim 14.

* * * * *